United States Patent [19]

Stoody

[11] 4,265,373

[45] May 5, 1981

[54] PRESSURIZED DISPENSER WITH DIP TUBE EXTENDING THROUGH SAC-IN-CAN

[76] Inventor: William R. Stoody, 15472 Collins Ave., Romulus, Mich. 48174

[21] Appl. No.: 41,867

[22] Filed: May 23, 1979

[51] Int. Cl.[3] ..... B65D 35/28

[52] U.S. Cl. ..... 222/94; 222/386.5; 222/402.18

[58] Field of Search ..... 239/323; 222/92, 94, 222/95, 386.5, 402.18

[56] References Cited

U.S. PATENT DOCUMENTS

| | | | |
|---|---|---|---|
| 3,178,075 | 4/1965 | Riedl et al. | 222/386.5 |
| 3,217,931 | 11/1965 | Farrar et al. | 222/94 |
| 3,300,102 | 1/1967 | Budzich | 222/386.5 |
| 3,317,090 | 5/1967 | Meshberg | 222/386.5 |
| 3,490,651 | 1/1970 | Abplanalp | 222/94 |
| 3,705,667 | 12/1972 | Blanie et al. | 222/386.5 X |
| 3,894,659 | 7/1975 | Focht | 222/94 |
| 3,992,003 | 11/1976 | Visceglia et al. | 222/94 |

FOREIGN PATENT DOCUMENTS

| | | | |
|---|---|---|---|
| 1416782 | 12/1975 | Canada | 222/94 |

*Primary Examiner*—David A. Scherbel

*Attorney, Agent, or Firm*—Cullen, Sloman, Cantor, Grauer, Scott & Rutherford

[57] ABSTRACT

An aerosol type dispenser, wherein a dispensable fluid product is in storage, under pressure, intermediate wall surfaces of the dispenser and exterior surfaces of a pliable, impervious, expandable sac. Propellant gas, contained in isolation within the confinements of the sac, influence expansible surfaces of the sac to exert an expulsion force to the product. A dispensing valve mechanism, of choice, is utilized for the appropriate dispensing application. Propellant vapors may be co-dispensed with the product to provide an atomized spray or the vapors can be used to remove product residue from the valve mechanism.

4 Claims, 4 Drawing Figures

PRESSURIZED DISPENSER WITH DIP TUBE EXTENDING THROUGH SAC-IN-CAN

RELATED APPLICATIONS

The applicant's related co-pending applications are; Ser. No. 860,354 filed Dec. 14, 1977 now U.S. Pat. No. 4,159,789 dated July 3, 1979, Ser. No. 887,580 filed March 17, 1978, now U.S. Pat. No. 4,189,069 dated Feb. 19, 1980, and Ser. No. 928,056 filed July 16, 1978 now U.S. Pat. No. 4,211,344.

BACKGROUND OF THE INVENTION

The present invention represents an economical and superior self-contained, portable aerosol dispenser that is in tune with energy and pollution attitudes of the present time. Smaller amounts of energy intensive, smog causing hydrocarbon propellants, can be used to accomplish the same spray results of present day aerosols without sacs. Problems associated with aerosols having a collapsible sac have been eliminated.

Heretofore, aerosol type dispensers included a rigid outer container, a valve mechanism, a dispensable fluid product in containment within a collapsible sac, liner, bag, etc., under pressure of propellant gas confined outside the said sac. Such dispensers have had limited application. All have at least one of the following disadvantages:

1. Sacs sized for efficient use, require preassembly within the container by a container manufacturer. Preassembly requires costly special handling, and is not generally accepted.
2. Sacs are of a reduced and inefficient size, for insertability through a universal size one inch annular opening in the container. Usually such sacs require prefilling with a fluid product, a difficult and expensive process.
3. Collapsible sacs are prone to paneling, a condition which entraps a substantial portion of the product.
4. Accessibility of propellant vapors for atomization or valve cleaning is prevented.
5. Filling with a fluid product must be accomplished through a valve mechanism, a slow costly procedure.
6. Introduction of the propellant must be accomplished in an unorthodox manner, requiring special equipment.

PRIOR ART

Other dispensers in the art, having a sac, are shown in the following U.S. Patents, also, the above listed itemized disadvantages, as applicable, are indicated in parentheses:

| U.S. PAT. NO. | INVENTOR | DIS-ADVANTAGE |
|---|---|---|
| 3,549,058 | E. J. Boik | (1,4,6) |
| 2,816,691 | L. T. Ward | (2,3,5) |
| 3,731,854 | D.E. Casey | (2,4,6) |
| 3,169,670 | P. Hrebernak, L. Zuckerman | (2,3,4,6) |
| 3,982,668 | P. R. Riccio | (2,3,5) |
| 3,610,481 | L. L. Marraffino | (2,3,5) |
| 3,520,450 | S. B. Prussin, et al | (2,3,5) |
| 3,525,456 | S. Prussin, et al | (2,3,5) |
| 3,583,606 | R. F. Ewald | (2,3,5) |
| 4,032,064 | E. D. Giggard | (1,4,6) |

The expanded liner disclosed in the L. T. Ward patent was merely to prevent an adverse reaction of intermixed product and propellant with the metal container. The sac has no effect on the dispensing function.

SUMMARY OF THE INVENTION

It is the object of the present invention to provide an aerosol type dispenser, of conventional dimensions and structure, wherein, propellant gas is confined within an expansible sac and is isolated from a dispensable fluid product.

It is another object to provide a conveyance for the product, to a dispensing valve mechanism.

Another object is to provide a sac contained dispenser within which the product has been disposed prior to the addition of the sac.

Another object is to provide a sac contained dispenser that can be pressurized in the same manner as dispensers without sacs.

It is a further object to provide a sac contained dispenser, from which a controlled amount of propellant gas vapor may be dispensed separately or co-dispensed with the fluid product.

These and other objects and advantages will be seen from the following specification and claims in conjunction with the appended drawings. The drawings are for illustration purposes only.

THE DRAWING

DETAILED DESCRIPTION OF THE INVENTION

Specific terminology resorted to in describing the illustrative embodiments of the invention is not intended to be limiting. It is understood that this is for clarity and includes all technical equivalents which function in a similar manner to accomplish a similar purpose or results.

Figure 1:
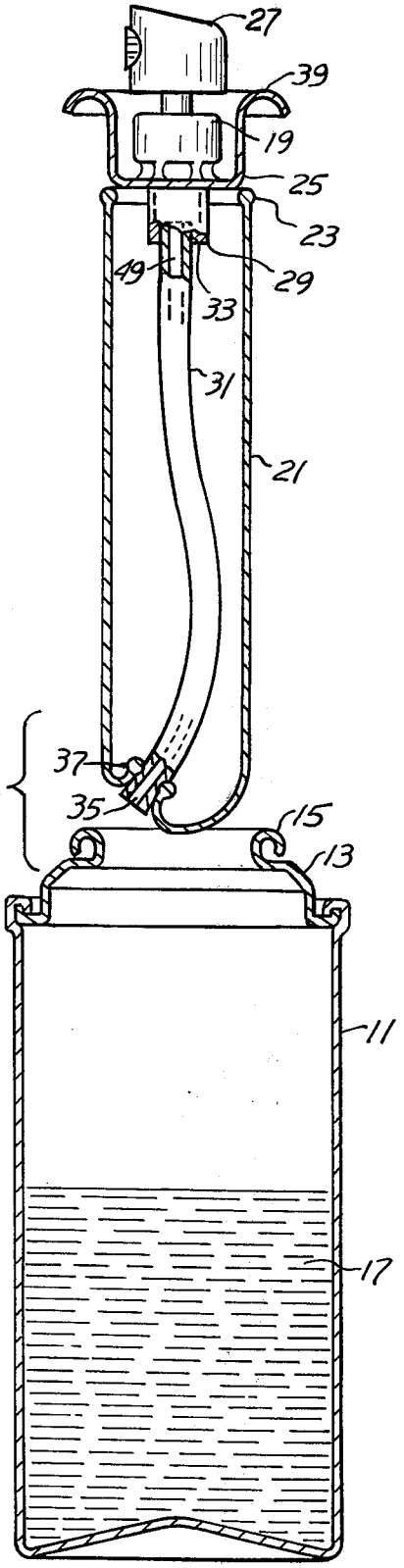
FIG. 1, is an exploded view of the present dispenser and sac.
Figure 2:
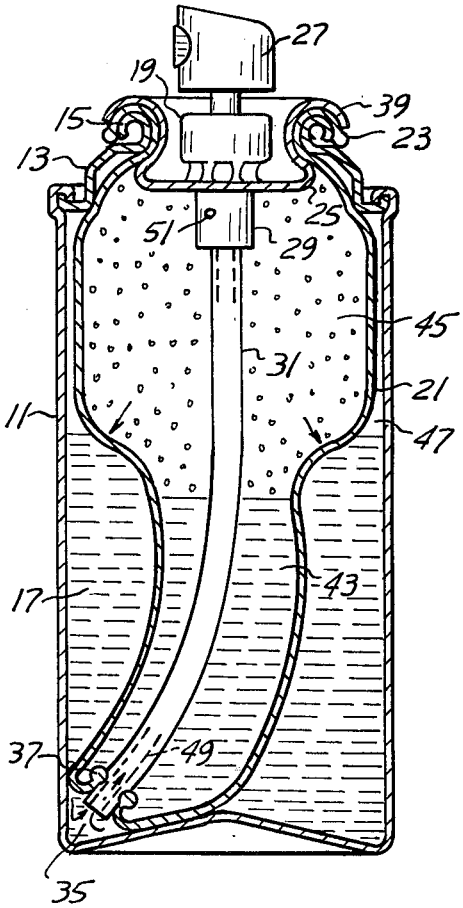
FIG. 2, is a vertical section of the assembled dispenser.

FIGS. 1 and 2, disposed within the closed bottom container 11, which includes a top closure 13 having an outwardly curled annular opening 15, is a predetermined amount of a dispensable fluid product 17. Partially inserted into container 11 is a valve mechanism 19 and expandable sac 21 which is capable of expanding to the internal extremities of container 11 and has an annular open end 23.

Valve mechanism 19 includes a disk-like valve retaining cup 25, an outwardly protruding movable dispensing nozzle 27, that is in communicating engagement with valve shut-off components, not shown, that are housed within a valve body 2. Depending from aperture 33 of the valve body 29 is a dip tube 31. An open end 35 of dip tube 31 is in secure engagement with an aperture 37 located in a lower extremity of sac 21.

Figure 3:
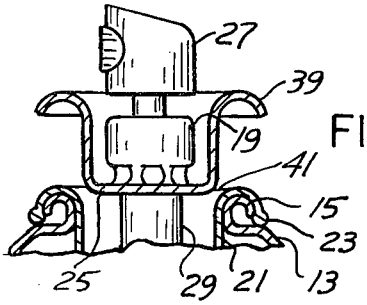
FIG. 3, is a fragmentary exploded view of the dispenser of FIG. 2.

Prior to pressurization, FIG. 3, annular opening 23 of sac 21 overlies and retainingly engages curled annular opening 15 of top closure 13. A matingly formed peripheral rim 39 of valve retaining cup 25 loosely rests above the resulting annular access opening 41 of sac 21.

Pressurization is accomplished by an industry preferred method known as, "over the cap filling". A propellant, of any suitable pressurizing material is employed, preferably a liquified pressure exerting gas that vaporizes at reduced pressures to a gaseous state and thereby maintain a predetermined pressure at a given temperature. One such propellant is hydrocarbon. Other pressurizing agents, such as compressed air, are suitable for use where a diminishing pressure, such as caused by dispensing a product, is not a detriment.

FIGS. 2 and 3, a liquified propellant 43 is forced into sac 21, passing under retaining cup rim 39 and through sac access opening 41. Valve mechanism 19 and sac 21 are secured in sealing engagement within top closure 13 immediately after a specified quantity of propellant has entered sac 21. This occurs in a single operation. Propellant 43 in a liquid state settles in the lower portion of sac 21, and propellant vapor 45 forms in the upper portion of sac 21.

FIG. 2, pressure exerted by propellant 43 and vapor 45 inflate sac 21 within container 11 forcing sac 21 to occupy the space above product 17. The pressure also causes sac 21 to exert an expulsion force on to product 17.

Entrapped air 47 intermediate container 11 and outer surfaces of sac 21 can be ignored since the air is also under equal pressure resulting from the forced expansion of sac 21. Air 47 thereby exerts equal pressure onto product 17. However should a reason exist, small apertures, not shown, can be placed in discreet locations of top closure 13. Air 47 could then escape. Expansion of sac 21 provides a sealing means within container 11 preventing product 17 from escaping.

Dispensing occurs when valve mechanism 19 is manually actuated. This generally occurs from depressing nozzle 27. Nozzle 27 subsequently forces valve shut-off components, not shown, housed in valve body 29 into their respective open positions. Product 17 under pressure is forcefully conveyed into valve mechanism 19 and ultimately out of nozzle 27 in an enclosed passageway 49 within sac 21 by virtue of dip tub 31. As product 17 is expelled, space initially occupied by product 17 is correspondingly consumed by sac 21.

In the present invention valve mechanism 19 is only defined to the extent necessary. Specific functional characteristics have been omitted since a variety of conventional valve mechanisms are applicable. The appropriate valve mechanism 19, choice depending on the dispensing application, will permit codispensing of product 17 with vapor 45 to achieve an atomized spray; separate dispensing whereas, propellant vapor 45 is dispensed only to remove product residue from within valve mechanism 19; dispensing product 17 only to prevent loss of propellant 43. The variety of dispensing applications are possible because vapor 45 is in confinement with valve body 29. Therefore vapor 45 is available to valve mechanism as through orifice 51, FIG. 2, as applicable. Examples of valve mechanisms that may be employed with shut-off components are shown in one or more of the above listed prior art patents. No claim is made to a specific valve mechanism.

MODIFICATION

Figure 4:
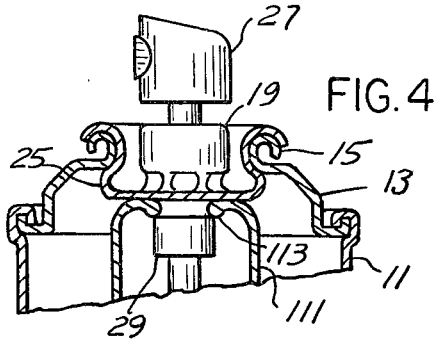
FIG. 4, is a similar view of a modification.

A modification, FIG. 4, differs from the above in that annular open end 113 of sac 111 is in secure sealing engagement with valve body 29. Valve mechanism 19 is sealingly secured and nested in annular curled opening 15 in top closure 13 prior to pressurization. Propellant 43 is forced into sac 111 by back-filling through valve mechanism 19. Such filling is common to aerosol packagers however, it is preferred only over unorthodox methods.

Having described my invention, reference should now be had to the following claims.

I claim:

1. A portable self-contained pressurized aerosol type dispenser comprising a rigid walled closed buttom container including a top closure having an outwardly curled annular opening;

a dispensing valve mechanism having at least a retaining cup secured in closing relation with the curled annular opening;

a valve body having shut-off components housed therein and product inlet passage;

an outwardly protruding movable discharge nozzle in communication with the shut-off components;

a dip tube having an open end depending from the valve body in communication with the inlet passage for delivery of a fluid product therethrough from the container;

a pliable impervious sac within the container adapted to expand to the internal extremities of the container, and having an annular open end secured in sealing engagement with the valve mechanism;

said container adapted to store a dispensible product, under pressure, intermediate the container and exterior surfaces of the sac;

said sac adapted to receive and confine therein a propellant gas that acts upon internal surfaces of the sac expanding the sac thereby exerting an expulsion force upon the product;

the open end of the dip tube extending through and sealed relative to the sac, providing an enclosed passageway within the sac for the conveyance of the product therethrough;

the valve mechanism being in communication with the interior of said container through said dip tube for dispensing said product from said container and into said dip tube and valve mechanism;

the valve mechanism having limited communication with the interior of the sac for releasing propellant vapors as well as said product through said nozzle.

2. In the dispenser of claim 1, the annular open end of the sac overlying in retaining engagement the outwardly curled annular opening in the top closure, thereby permitting introduction of a pressurizing propellant, and thereafter secured and sealingly retained by the retaining cup.

3. In the dispenser of claim 1, the annular open end of the sac being secured to and retained in sealing engagement with the valve body.

4. A portable self-contained pressurized aerosol type dispenser comprising a rigid walled closed bottom container including a top closure having an outwardly curled annular opening;

a dispensing valve mechanism having at least a retaining cup secured in closing relation with the curled annular opening;

a valve body having shut-off components housed therein having first and second control positions, and a product inlet passage;

an outwardly protruding movable discharge nozzle in communication with the shut-off components;

a dip tube having an open end depending from the valve body in communication with the inlet passage for delivery of a fluid product therethrough from the container;

a pliable impervious sac within the container adapted to expand to the internal extremities of the container, and having an annular open end secured in sealing engagement with the valve mechanism;

said container adapted to store a dispensible product, under pressure intermediate the container and exterior surfaces of the sac;

said sac adapted to receive and confine therein a propellant gas that acts upon internal surfaces of the sac expanding the sac thereby exerting an expulsion force upon the product;

the open end of the dip tube extending through and sealed relative to the sac, providing an enclosed passageway within the sac for the conveyance of the product therethrough;

the valve mechanism in one control position being in communication with the interior of said container through said dip tube for dispensing said product from said container and into said dip tube and valve mechanism, and in said second control position being additionally in limited communication with the interior of said sac for releasing propellant vapors through said valve mechanism.

* * * * *

UNITED STATES PATENT AND TRADEMARK OFFICE

CERTIFICATE OF CORRECTION

PATENT NO. : 4,265,373

DATED : May 5, 1981

INVENTOR(S) : William R. Stoody

It is certified that error appears in the above-identified patent and that said Letters Patent is hereby corrected as shown below:

On The Title Page, item [76] should read

-- [76] Inventor: William R. Stoody
8659 Summerdale
San Diego, Calif. 92126 --.

Signed and Sealed this

Ninth Day of November 1982

[SEAL]

Attest:

GERALD J. MOSSINGHOFF

Attesting Officer

Commissioner of Patents and Trademarks